US009638190B2

(12) United States Patent
Yoshida et al.

(10) Patent No.: US 9,638,190 B2
(45) Date of Patent: May 2, 2017

(54) OIL PUMP

(71) Applicant: JTEKT Corporation, Osaka-shi (JP)

(72) Inventors: Naohito Yoshida, Takahama (JP); Kazuhiro Watanabe, Nagoya (JP)

(73) Assignee: JTEKT CORPORATION, Osaka-shi (JP)

( * ) Notice: Subject to any disclaimer, the term of this patent is extended or adjusted under 35 U.S.C. 154(b) by 200 days.

(21) Appl. No.: 14/485,930

(22) Filed: Sep. 15, 2014

(65) Prior Publication Data

US 2015/0078948 A1 Mar. 19, 2015

(30) Foreign Application Priority Data

Sep. 17, 2013 (JP) ..... 2013-191503

(51) Int. Cl.
*F01C 21/10* (2006.01)
*F04C 15/00* (2006.01)
(Continued)

(52) U.S. Cl.
CPC ..... *F04C 15/064* (2013.01); *F01C 21/108* (2013.01); *F04C 2/10* (2013.01);
(Continued)

(58) Field of Classification Search
CPC .... F01C 21/108; F04C 15/0049; F04C 15/06; F04C 15/064; F04C 2/10; F04C 2/3446
(Continued)

(56) References Cited

U.S. PATENT DOCUMENTS

2003/0044300 A1* 3/2003 Osugi ..... F01C 21/0827 418/260
2003/0059312 A1* 3/2003 Konishi ..... F01C 21/0863 417/213

(Continued)

FOREIGN PATENT DOCUMENTS

JP 2001-248569 A 9/2001
JP 2007-100604 A 4/2007
JP 2009-209817 9/2009

OTHER PUBLICATIONS

Extended European Search Report issued Apr. 24, 2015 in Patent Application No. 14184609.7.

*Primary Examiner* — Nicholas J Weiss
*Assistant Examiner* — Dapinder Singh
(74) *Attorney, Agent, or Firm* — Oblon, McClelland, Maier & Neustadt, L.L.P.

(57) ABSTRACT

An oil pump includes a rotor, an outer peripheral member accommodating the rotor, a first plate, and a second plate. A discharge passage through which hydraulic fluid is discharged is connected to a discharge port of the first plate. A first pressure gradually-changing groove and a second pressure gradually-changing groove are formed such that a second flow passage area is larger than a first flow passage area, the first flow passage area being a flow passage area of the first pressure gradually-changing groove of the first plate, at a position at which the first pressure gradually-changing groove communicates with a transfer chamber passing through a sealed region, and the second flow passage area being a flow passage area of the second pressure gradually-changing groove of the second plate, at a position at which the second pressure gradually-changing groove communicates with the transfer chamber passing through the sealed region.

5 Claims, 5 Drawing Sheets

(51) Int. Cl.
*F04C 15/06* (2006.01)
*F04C 2/10* (2006.01)
*F04C 2/344* (2006.01)

(52) U.S. Cl.
CPC ..... *F04C 2/3446* (2013.01); *F04C 15/0049* (2013.01); *F04C 15/06* (2013.01)

(58) Field of Classification Search
USPC ..... 418/260, 261, 268, 265, 269
See application file for complete search history.

(56) References Cited

U.S. PATENT DOCUMENTS

2013/0052071 A1* 2/2013 Nishikawa ..... F01C 21/0863
418/106
2013/0052073 A1* 2/2013 Ishihama ..... F04C 2/344
418/268
2013/0280118 A1* 10/2013 Akatsuka ..... F01C 21/0863
418/191

* cited by examiner

AS VIEWED FROM DIRECTION AA

AS VIEWED FROM DIRECTION BB

Prior Art

OIL PUMP

INCORPORATION BY REFERENCE

The disclosure of Japanese Patent Application No. 2013-191503 filed on Sep. 17, 2013 including the specification, drawings and abstract, is incorporated herein by reference in its entirety.

BACKGROUND OF THE INVENTION

1 . Field of the Invention

The invention relates to an oil pump including a rotor that is driven to be rotated, and an outer peripheral member that has a cylindrical shape and that accommodates the rotor.

2 . Description of the Related Art

For example, a conventional oil pump 101 illustrated in FIG. 8 includes: a rotor 130 that is driven to be rotated by a rotary shaft 150 that rotates about a rotation axis Z150 (the rotary shaft 150 is driven to be rotated clockwise in an example illustrated in FIG. 8); an outer peripheral member 140 that has a generally cylindrical shape and that accommodates the rotor 130; a first plate 110 that covers one of end faces of the outer peripheral member 140 (the first plate 110 is disposed on the opposite side of the outer peripheral member 140 from a person who sees FIG. 8 in a direction perpendicular to the sheet on which FIG. 8 is drawn); and a second plate (not illustrated) that covers the other one of the end faces of the outer peripheral member 140 (the second plate is disposed on the side closer to the person who sees FIG. 8). An outer peripheral portion of the rotor 130 is provided with a plurality of vanes 131 urged radially outward, and ten transfer chambers 130V are defined by an outer peripheral face of the rotor 130, an inner peripheral face of the outer peripheral member 140, the first plate 110, the second plate, and the vanes 131. As illustrated in FIG. 8, when the rotor 130 rotates clockwise, the volume of each transfer chamber 130V that is passing through a suction region 110K (a suction region 111*k*) including a suction port 110*in* (a suction port 111*in*) gradually increases and hydraulic fluid is sucked in through the suction port 110*in* (the suction port 111*in*). At the same time, the volume of each transfer chamber 130V that is passing through a discharge region 110T (a discharge region 111T) including a discharge port 110*ex* (a discharge port 111*ex*) gradually decreases and the hydraulic fluid is discharged to the discharge port 110*ex* (the discharge port 111*ex*). A sealed region 110F (a sealed region 111F) is a region extending from the end point of the suction port 110*in* (the suction port 111*in*) to the start point of the discharge port 110*ex* (the discharge port 111*ex*). The transfer chamber 130V that has reached the end point of the suction port 110*in* (the suction port 111*in*) passes through the sealed region 110F (the sealed region 111F) before reaching the start point of the discharge port 110*ex* (the discharge port 111*ex*) as the rotor 130 rotates. The volume of each transfer chamber 130V that is passing through the sealed region 110F (the sealed region 111F) is kept nearly unchanged.

When the transfer chamber 130V reaches the discharge region 110T (the discharge region 111T) after passing through the sealed region 110F (the sealed region 111F), the hydraulic fluid at high pressure suddenly flows into the transfer chamber 130V from the discharge port 110*ex* (the discharge port 111*ex*), so that the pressure of the hydraulic fluid in the transfer chamber 130V abruptly increases. As a result, cavitation, which is a phenomenon in which air bubbles are generated and disappear, is likely to occur. Occurrence of cavitation should be avoided, because it may be a factor of generation of noise and erosion. Therefore, a pressure gradually-changing groove 110M (a pressure gradually-changing groove 111M) is formed in each of the first plate 110 and the second plate. The hydraulic fluid from the discharge port 110*ex* (the discharge port 111*ex*) is gradually supplied into the transfer chamber 130V that is passing through the sealed region 110F (the sealed region 111F) to avoid an abrupt increase in the pressure of the hydraulic fluid in the transfer chamber 130V. The pressure gradually-changing grooves formed in the first plate 110 and the pressure gradually-changing grooves formed in the second plate are opposed to each other.

Japanese Patent Application Publication No. 2009-209817 (JP 2009-209817 A) describes an oil pump in which a shallow bottom portion and a V-shaped valley portion (corresponding to the pressure gradually-changing groove) are formed at a position adjacent to the start point of a discharge port of a pump casing, in the sealed region 110F (the sealed region 111F) illustrated in FIG. 8. In this oil pump, it is possible to more reliably prevent erosion.

JP 2009-209187 A does not clearly describe whether the shallow bottom portion and the V-shaped valley portion are formed on each of both end face sides of an inner rotor and an outer rotor, and thus it may be deemed that they are formed on one of the end face sides. Even if they are formed on each of both end face sides, it may be deemed that the shallow bottom portion and the V-shaped valley portion have the same sizes and shapes. In order to reliably prevent erosion, it is preferable to cause the hydraulic fluid at high pressure to flow from the discharge port into each transfer chamber from both end face sides, instead of causing the hydraulic fluid at high pressure to flow from the discharge port into each transfer chamber from one end face side. However, if the hydraulic fluid at high pressure is simply introduced from the suction port into each transfer chamber from the both end face sides, the pressure difference between the hydraulic fluid introduced from one end face side and the hydraulic fluid introduced from the other end face side becomes large, and such large pressure difference may promote occurrence of cavitation. In a state where dynamic flow of hydraulic fluid is caused in an oil pump rotating at a high speed, even if the pressure gradually-changing grooves (or shallow bottom portions and the V-shaped valley portions) are formed in the same shape and size, a pressure difference may be caused due to various factors.

SUMMARY OF THE INVENTION

One object of the invention is to provide an oil pump having pressure gradually-changing grooves formed near discharge ports on both end face sides of a rotor, the oil pump being configured to suppress occurrence of cavitation by decreasing the difference between the pressure of the hydraulic fluid that flows into a transfer chamber through a pressure gradually-changing groove on one end face side and the pressure of the hydraulic fluid that flows into the transfer chamber through a pressure gradually-changing groove on the other end face side.

An oil pump according to an aspect of the invention includes: a rotor that is driven to be rotated; an outer peripheral member that has a generally cylindrical shape and that accommodates the rotor; a first plate disposed so as to cover an opening at one end face of the outer peripheral member having the generally cylindrical shape; and a second plate disposed so as to cover an opening at the other end face of the outer peripheral member having the generally cylindrical shape. A clearance is defined between an outer peripheral face of the rotor and an inner peripheral face of the outer peripheral member. The clearance is partitioned into a plurality of transfer chambers arranged in a circumferential direction of the rotor. The volume of each of the transfer chambers gradually changes as the rotor rotates. Suction ports in the form of recesses are respectively formed in a face of the first plate and a face of the second plate, the faces being opposed to the transfer chambers, the suction ports including at least part of a region in which the volume of each of the transfer chambers gradually increases, and the suction port of the first plate and the suction port of the second plate being formed at such positions as to be opposed to each other. Discharge ports in the form of recesses are respectively formed in the face of the first plate and the face of the second plate, the faces being opposed to the transfer chambers, the discharge ports including at least part of a region in which the volume of each of the transfer chambers gradually decreases, and the discharge port of the first plate and the discharge port of the second plate being formed at such positions as to be opposed to each other. A discharge passage through which hydraulic fluid is discharged is connected to the discharge port of the first plate, and the discharge port of the second plate is connected to the discharge passage via the transfer chamber that has reached the discharge port of the second plate and the discharge port of the first plate. A first pressure gradually-changing groove and a second pressure gradually-changing groove are formed respectively in the first plate and the second plate so as to extend from the discharge ports toward the suction ports, the first and second pressure gradually-changing grooves being formed in a sealed region through which the transfer chamber that has reached end points of the suction ports passes before reaching start points of the discharge ports, the first and second pressure gradually-changing grooves gradually supplying the hydraulic fluid from the discharge ports to the transfer chamber that is passing through the sealed region. The first pressure gradually-changing groove and the second pressure gradually-changing groove are formed such that a second flow passage area is larger than a first flow passage area, the first flow passage area being a flow passage area of the first pressure gradually-changing groove of the first plate, at a position at which the first pressure gradually-changing groove is communicated with the transfer chamber that is passing through the sealed region, and the second flow passage area being a flow passage area of the second pressure gradually-changing groove of the second plate, at a position at which the second pressure gradually-changing groove is communicated with the transfer chamber that is passing through the sealed region.

In the oil pump according to the above aspect, the discharge passage is connected to the discharge port of the first plate, and the discharge port of the second plate is connected to the discharge passage via the transfer chamber that has reached the discharge port of the second plate and the discharge port of the first plate. With this configuration, in the oil pump that rotates at a high speed, the pressure of the hydraulic fluid in the discharge port of the first plate, which is closer to the discharge passage than the second plate, tends to be higher than that in the discharge port of the second plate. Thus, if the first pressure gradually-changing groove of the first plate and the second pressure gradually-changing groove of the second plate have the same shape and size, the pressure of the hydraulic fluid that flows into the transfer chamber from the first pressure gradually-changing groove is higher than the pressure of the hydraulic fluid that flows into the transfer chamber from the second pressure gradually-changing groove. Thus, the first pressure gradually-changing groove and the second pressure gradually-changing groove are formed such that the second flow passage area of the second pressure gradually-changing groove is larger than the first flow passage area of the first pressure gradually-changing groove. As a result, it is possible to suppress occurrence of cavitation by decreasing the difference between the pressure of the hydraulic fluid that flows into the transfer chamber through the first pressure gradually-changing groove and the pressure of the hydraulic fluid that flows into the transfer chamber through the second pressure gradually-changing groove.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
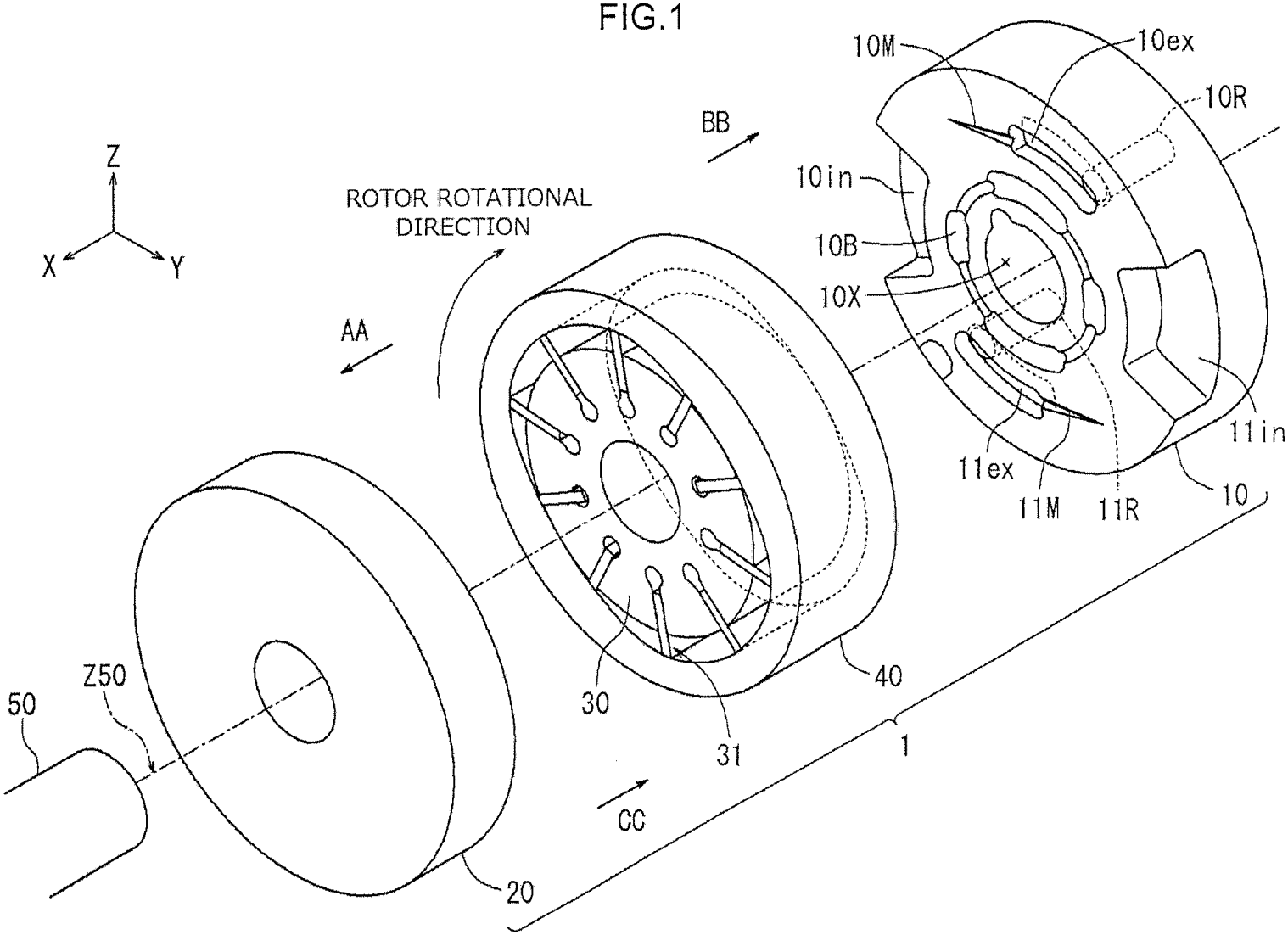
FIG. 1 is an exploded perspective view illustrating an example of the configuration of an oil pump according to an embodiment of the invention.

Hereinafter, an embodiment of the invention will be described with reference to the accompanying drawings. As illustrated in an exploded perspective view in FIG. 1, an oil pump 1 includes, for example, a first plate 10, a rotor 30, an outer peripheral member 40, and a second plate 20. The rotor 30 is driven to be rotated by a shaft 50 that rotates about a rotation axis Z50. The outer peripheral member 40 has a generally cylindrical shape, and accommodates the rotor 30. The outer peripheral member 40 has an inner peripheral face having a generally elliptical sectional shape (refer to FIG. 4) so that partial clearances are formed between an outer peripheral face of the rotor 30 and the inner peripheral face of the outer peripheral member 40. An outer peripheral portion of the rotor 30 is provided with a plurality of vanes 31 urged radially outward. The first plate 10 is disposed so as to cover an opening at one end face of the outer peripheral member 40. The second plate 20 is disposed so as to cover an opening at the other end face of the outer peripheral member 40.

Figure 2:
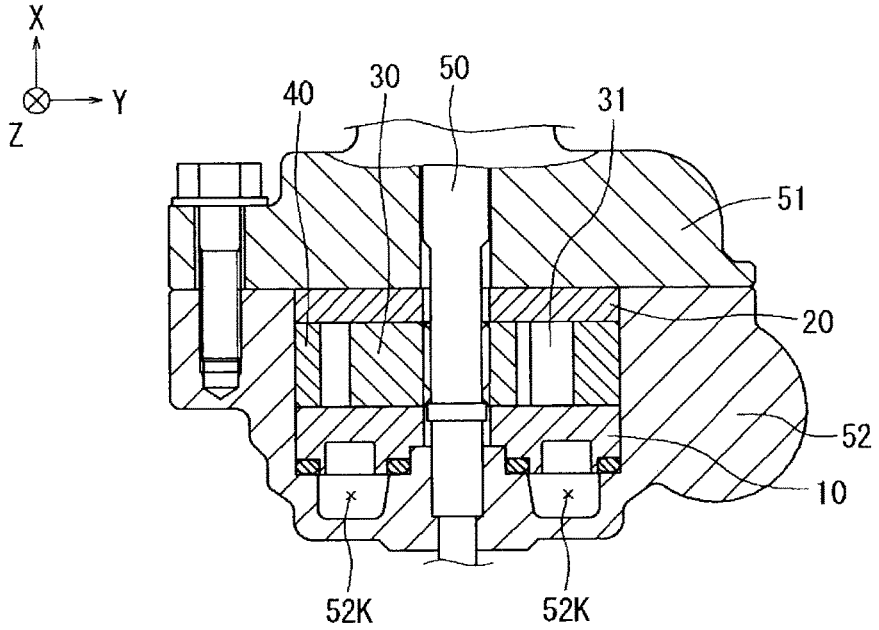
FIG. 2 is a sectional view taken along the axial direction of the oil pump, illustrating the state where the oil pump is fitted to pump housings.

As illustrated in FIG. 2, the outer peripheral member 40 that accommodates the rotor 30 is held between the first plate 10 and the second plate 20, which are located on the opposite sides of the outer peripheral member 40, and is accommodated in and secured to pump housings 51, 52. As a result, the first plate 10, the second plate 20 and the outer peripheral member 40 are secured to the pump housings 51, 52. The shaft 50 is passed through a through-hole of the rotor 30, so that the rotor 30 is driven to be rotated via the shaft 50. Discharge passages 52K are formed in the pump housing 52. The discharge passages 52K are passages through which the hydraulic fluid discharged from the oil pump 1 including the first plate 10, the second plate 20, the rotor 30, and the outer peripheral member 40 flows. The discharge passages 52K are respectively communicated with a discharge port 10*ex* and a discharge port 11*ex*, at a communication hole 10R formed in the discharge port 10*ex* and a communication hole 11R formed in the discharge port 11*ex* in the first plate 10 illustrated in FIG. 3B. Note that, in FIG. 2, suction passages through which the hydraulic fluid is sucked into the oil pump 1 are not illustrated.

Figure 3A:
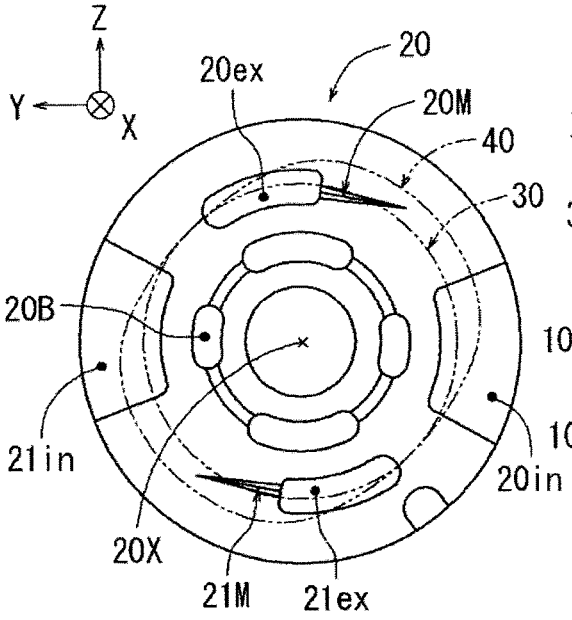
FIG. 3A is a view illustrating the external appearance of a second plate as viewed from a direction AA in FIG. 1.
Figure 3B:
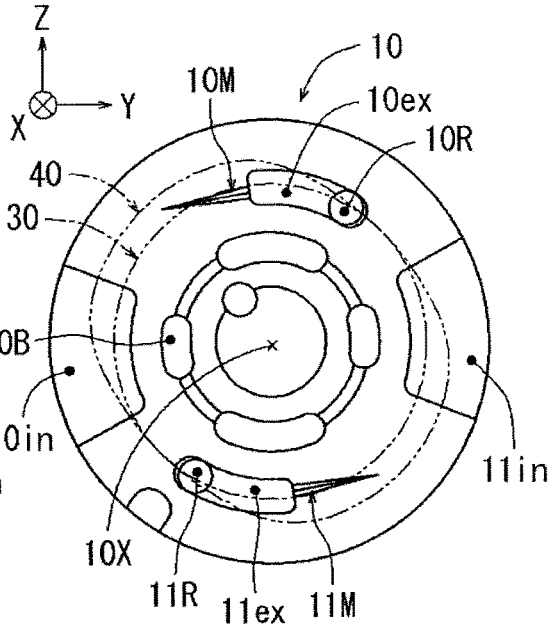
FIG. 3B is a view illustrating the external appearance of a first plate as viewed from a direction BB in FIG. 1.

FIG. 3A illustrates the external appearance of the second plate 20 as viewed from the direction AA in FIG. 1. FIG. 3B illustrates the external appearance of the first plate 10 as viewed from the direction BB in FIG. 1. As illustrated in FIG. 3A, suction ports 20*in*, 21*in* that are in the form of recesses, discharge ports 20*ex*, 21*ex* that are in the form of recesses, a vane oil passage 20B that is in the form of a recess, and a through-hole 20X are formed in a opposed face of the second plate 20, which is opposed to the outer peripheral member 40 and the rotor 30. A second pressure gradually-changing groove 20M is formed so as to extend toward the suction port 20*in* from the start point of the discharge port 20*ex* (the right end of the discharge port 20*ex* in FIG. 3A). A second pressure gradually-changing groove 21M is formed so as to extend toward the suction port 21 in from the start point of the discharge port 21*ex* (the left end of the discharge port 21*ex* in FIG. 3A).

As illustrated in FIG. 3B, suction ports 10*in*, 11*in* that are in the form of recesses, discharge ports 10*ex*, 11*ex* that are in the form of recesses, a vane oil passage 10B that is in the form of a recess, and a through-hole 10X are formed in a opposed face of the first plate 10, which is opposed to the outer peripheral member 40 and the rotor 30. The communication hole 10R communicated with the discharge passage (see 52K in FIG. 2) is formed in the discharge port 10*ex*, and the communication hole 11R communicated with the discharge passage is formed in the discharge port 11*ex*. A first pressure gradually-changing groove 10M is formed so as to extend toward the suction port 10*in* from the start point of the discharge port 10*ex* (the left end of the discharge port 10*ex* in FIG. 3B). A first pressure gradually-changing groove 11M is formed so as to extend toward the suction port 11*in* from the start point of the discharge port 11*ex* (the right end of the discharge port 11*ex* in FIG. 3B).

In the assembled state illustrated in FIG. 2, the suction port 10*in* and the suction port 20*in* are opposed to each other, the suction port 11 in and the suction port 21*in* are opposed to each other, the discharge port 10*ex* and the discharge port 20*ex* are opposed to each other, the discharge port 11*ex* and the discharge port 21*ex* are opposed to each other, and the first pressure gradually-changing groove 10M and the second pressure gradually-changing groove 20M are opposed to each other, and the first pressure gradually-changing groove 11M and the second pressure gradually-changing groove 21 M are opposed to each other. The vanes 31 are urged radially outward by the hydraulic fluid supplied from the vane oil passages 10B, 20B.

Figure 4:
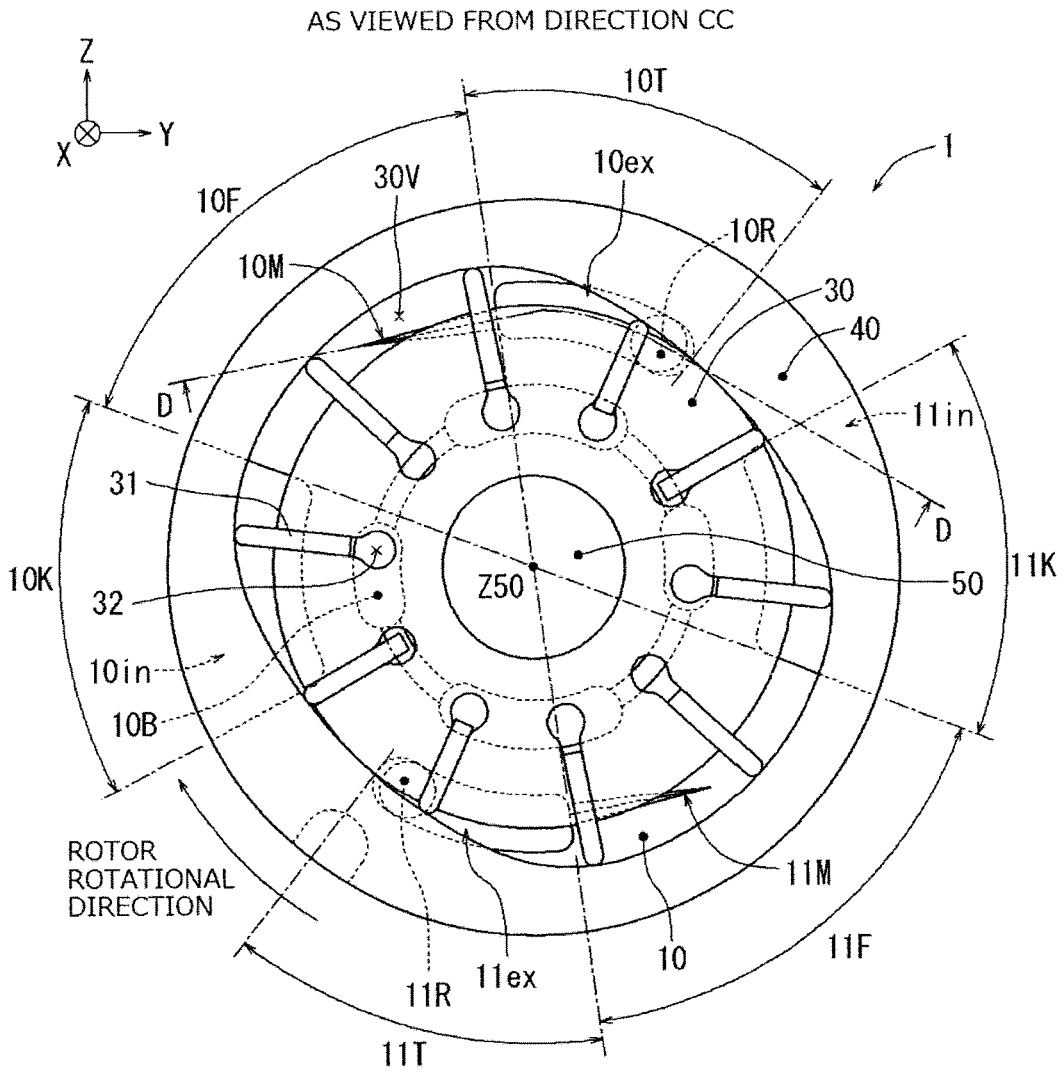
FIG. 4 is a view illustrating the positions of transfer chambers, the positions of suction ports and the positions of discharge ports, in a rotor, an outer peripheral member, and the first plate as viewed from a direction CC in FIG. 1.

FIG. 4 is a view illustrating, for example, the positions of the transfer chambers 30V, the positions of the suction ports 10*in*, 11*in*, and the positions of the discharge ports 10*ex*, 11*ex*, in the rotor 30, the outer peripheral member 40 and the first plate 10, as viewed from the direction CC in FIG. 1. Note that, the rotor 30 rotates clockwise in an example illustrated in FIG. 4.

As illustrated in FIG. 4, multiple transfer chambers 30V are defined between the outer peripheral face of the rotor 30 and the inner peripheral face of the outer peripheral member 40. The transfer chambers 30V are spaces separated from each other in the circumferential direction by the vanes 31. The volume of each transfer chamber 30V gradually changes as the rotor 30 rotates. A suction region 10K (a suction region 11K) is a region in which the volume of each transfer chamber 30V gradually increases as the rotor 30 rotates and the suction port 10*in* (the suction port 11*in*) and the transfer chamber 30V are brought into contact with each other, so that the hydraulic fluid is sucked from the suction port 10*in* (the suction port 11*in*) into the transfer chamber 30V. The suction port 10*in* (the suction port 11*in*) is formed in at least part of the region where the volume of the transfer chamber 30V gradually increases. A discharge region 10T (a suction region 11T) is a region in which the volume of each transfer chamber 30V gradually decreases as the rotor 30 rotates and the discharge port 10*ex* (the discharge port 11*ex*) and the transfer chamber 30V are brought into contact with each other, so that the hydraulic fluid is discharged from the transfer chamber 30V to the discharge port 10*ex* (the discharge port 11*ex*). The discharge port 10*ex* (the discharge port 11*ex*) is formed in at least part of the region where the volume of the transfer chamber 30V gradually decreases. The communication hole 10R (the communication hole 11R) communicated with the discharge passage (see 52K in FIG. 2) is formed at the end point of the discharge port 10*ex* (the discharge port 11*ex*) of the first plate 10.

A sealed region 10F (a sealed region 11F) is a region extending from the end point of the suction port 10*in* (the suction port 11*in*) to the start point of the discharge port 10*ex* (the discharge port 11*ex*). The transfer chamber 30V that has reached the end point of the suction port 10*in* (the suction port 11*in*) passes through the sealed region 10F (the sealed region 11F) before reaching the start point of the discharge port 10*ex* (the discharge port 11*ex*) as the rotor 30 rotates. In the sealed region 10F (the sealed region 11F), the first pressure gradually-changing groove 10M (the first pressure gradually-changing groove 11M) is formed so as to extend toward the suction port 10*in* (or the suction port 11*in*) from the start point of the discharge port 10*ex* (the discharge port 11*ex*).

Figure 5:
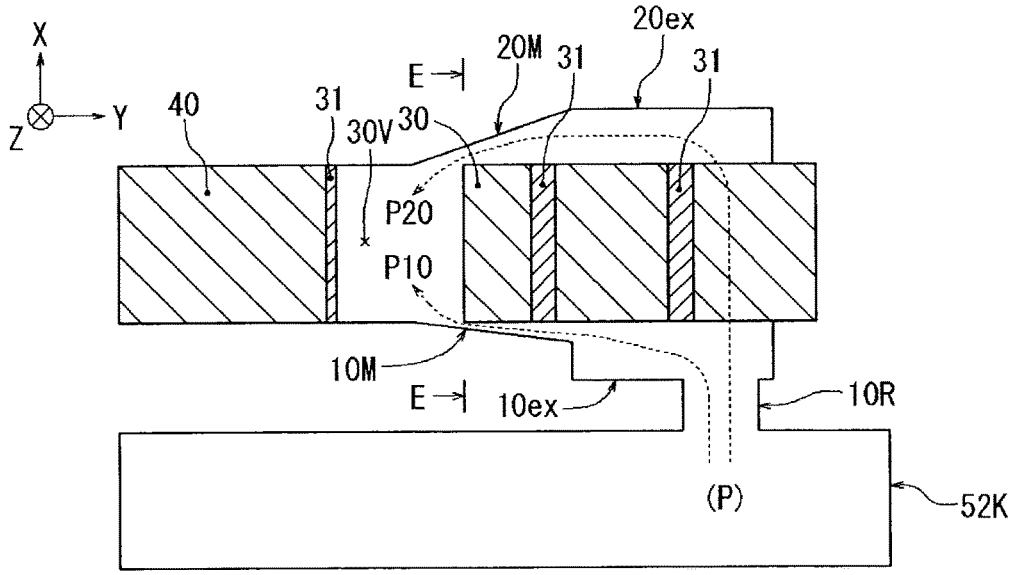
FIG. 5 is a sectional view taken along the line D-D in FIG. 4, illustrating the position of the transfer chamber that is passing through a sealing region and that has reached a first pressure gradually-changing groove and a second pressure gradually-changing groove, and the position of a discharge passage.
Figure 6A:
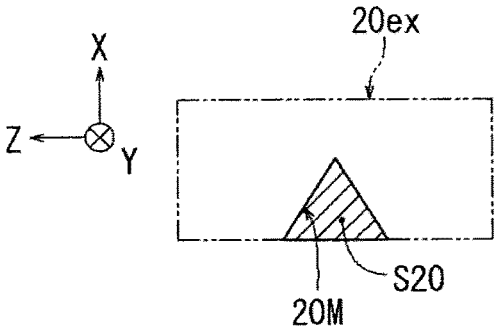
FIG. 6A is a view illustrating a second flow passage area.
Figure 6B:
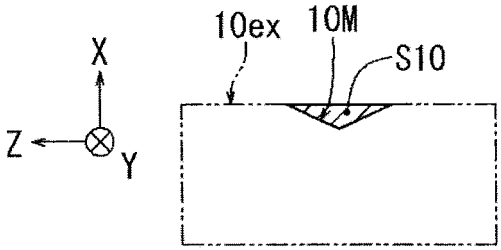
FIG. 6B is a view illustrating a first flow passage area.

FIG. 5 is a sectional view taken along the line D-D in FIG. 4, illustrating, for example, the position of the transfer chamber 30V that is passing through the sealed region 10F and that has reached the first pressure gradually-changing groove 10M and the second pressure gradually-changing groove 20M, and the position of the discharge passage 52K. The discharge port 10*ex* and the discharge port 20*ex* illustrated in FIG. 5 are communicated with each other by the transfer chamber 30V that is passing through the sealed region 10F (refer to FIG. 4), and the discharge port 10*ex* is communicated with the discharge passage 52K through the communication hole 10R. FIG. 6A illustrates the section of the second pressure gradually-changing groove 20M in a section taken along the line E-E in FIG. 5. FIG. 6B illustrates the section of the first pressure gradually-changing groove 10M in a section taken along the line E-E in FIG. 5.

In a static state, the pressures of the hydraulic fluid in the discharge port 20*ex* and the discharge port 10*ex* that are communicated with each other, the pressure of the hydraulic fluid in the transfer chamber 30V that provides communication between the discharge port 20*ex* and the discharge port 10*ex*, and the pressure of the hydraulic fluid in the discharge passage 52K are all supposed to be equal to each other. However, actually, the rotor 30 rotates at a high speed to cause the hydraulic fluid to flow at a high speed, and thus the pressures of the hydraulic fluid at the above-described locations are different from each other. Actually, a pressure (P10) of the hydraulic fluid in the discharge port 10*ex*, which is located closer to the discharge passage 52K than the discharge port 20*ex*, is higher than a pressure (P20) of the hydraulic pressure in the discharge port 20*ex* (P10>P20). Thus, in FIG. 5, when the quantity of the hydraulic fluid that flows from the discharge port 20*ex* into the transfer chamber 30V through the second pressure gradually-changing groove 20M is equal to the quantity of the hydraulic fluid that flows from the discharge port 10*ex* into the transfer chamber 30V through the first pressure gradually-changing groove 10M, cavitation may be caused due to the pressure difference in the hydraulic fluids flowing into the transfer chamber 30V.

Thus, in order to decrease the difference between the pressure of the hydraulic fluid that flows from the discharge port 20*ex* into the transfer chamber 30V through the second pressure gradually-changing groove 20M and the pressure of the hydraulic fluid that flows from the discharge port 10*ex* into the transfer chamber 30V through the first pressure gradually-changing groove 10M, the quantity of the hydraulic fluid at a lower pressure, which flows from the discharge port 20*ex* into the transfer chamber 30V through the second pressure gradually-changing groove 20M is made larger than the quantity of the hydraulic fluid flowing from the discharge port 10*ex* into the transfer chamber 30V through the first pressure gradually-changing groove 10M. In order to achieve this state, the following configuration is employed. The first pressure gradually-changing groove 10M and the second pressure gradually-changing groove 20M are formed such that a second flow passage area (a second flow passage area S20 in FIG. 6A) is larger than a first flow passage area (a first flow passage area S10 in FIG. 6B). The first flow passage area is a flow passage area of the first pressure gradually-changing groove 10M, at a position at which the first pressure gradually-changing groove 10M is communicated with (connected to) the transfer chamber 30V that is passing through the sealed region 10F (at a position on the section taken along the line E-E in FIG. 5). The second flow passage area is a flow passage area of the second pressure gradually-changing groove 20M, at a position at which the second pressure gradually-changing groove 20M is communicated with (connected to) the transfer chamber 30V that is passing through the sealed region 10F (at a position on the section taken along the line E-E in FIG. 5).

The inventors confirmed the fact that, when the first pressure gradually-changing groove 10M and the second pressure gradually-changing groove 20M are formed in an oil pump such that the second flow passage area S20 is substantially twice as large as the first flow passage area S10, the difference between the pressure of the hydraulic fluid flowing into the transfer chamber 30V through the first pressure gradually-changing groove 10M and the pressure of the hydraulic fluid flowing into the transfer chamber 30V through the second pressure gradually-changing groove 20M becomes substantially equal to zero and thus occurrence of cavitation is suppressed. Note that, the optimum ratio of the second flow passage area S20 to the first flow passage area S10 varies depending on kinds or dimensions of oil pumps. Thus, it is preferable to set the ratio of the second flow passage area S20 to the first flow passage area S10 such that the pressure of the hydraulic fluid flowing into the transfer chamber 30V that is passing through the sealed region 10F from the first pressure gradually-changing groove 10M is equal to the pressure of the hydraulic fluid flowing into the transfer chamber 30V that is passing through the sealed region 10F from the second pressure gradually-changing groove 20M.

Figure 7A:
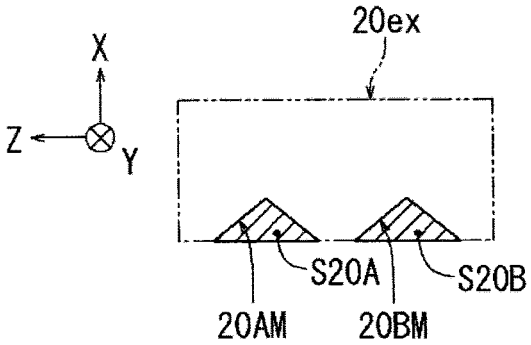
FIG. 7A is a view illustrating second flow passage areas.
Figure 7B:
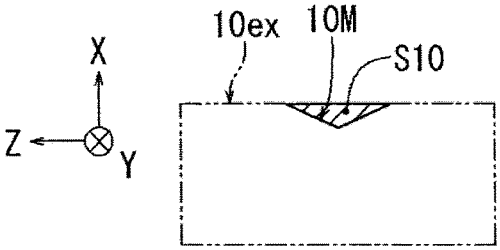
FIG. 7B is a view illustrating a first flow passage area.
Figure 8:
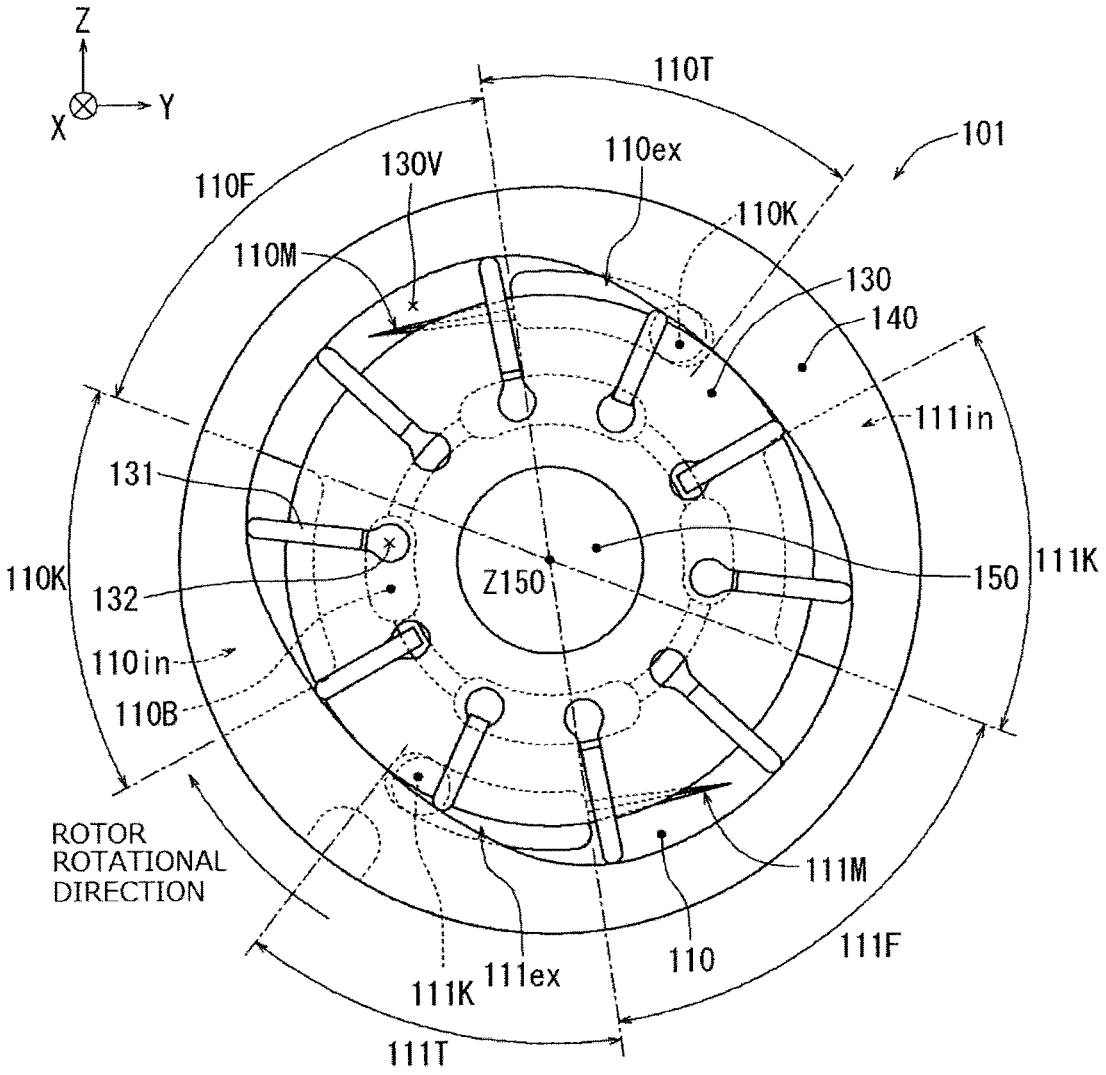
FIG. 8 is a view illustrating an example of a conventional oil pump.

In the example illustrated in FIG. 6A and FIG. 6B, the width and/or depth of the second pressure gradually-changing groove 20M are/is set larger than the width and/or depth of the first pressure gradually-changing groove 10M to set the second flow passage area S20 larger than the first flow passage area S10. However, as illustrated in FIG. 7A and FIG. 7B, a plurality of second pressure gradually-changing grooves 20AM, 20BM may be formed to set the second flow passage area (a second flow passage area S20A+a second flow passage area 520B) larger than the first flow passage area S10. In this case, formation of the second pressure gradually-changing grooves is facilitated. As a result, it is possible to facilitate manufacturing of the oil pump.

Note that various changes may be made to the configuration, structure, external appearance and shape of the oil pump 1 without departing from the scope of the invention. Further, the invention should not be limited to the oil pump having the configuration described in the aforementioned embodiment, but may be applied to any kinds of oil pumps. For example, the invention may be applied to an internal gear pump in which an inner rotor having a plurality of teeth formed on its outer peripheral face is eccentrically inscribed in an outer rotor having a plurality of teeth formed on its inner peripheral face.

What is claimed is:

1. An oil pump comprising:

a rotor that is driven to be rotated;

an outer peripheral member that has a generally cylindrical shape and that accommodates the rotor;

a first plate disposed so as to cover an opening at one end face of the outer peripheral member having the generally cylindrical shape; and a second plate disposed so as to cover an opening at the other end face of the outer peripheral member having the generally cylindrical shape, wherein a clearance is defined between an outer peripheral face of the rotor and an inner peripheral face of the outer peripheral member, the clearance is partitioned into a plurality of transfer chambers arranged in a circumferential direction of the rotor, a volume of each of the transfer chambers gradually changes as the rotor rotates, suction ports in the form of recesses are respectively formed in a face of the first plate and a face of the second plate, the faces being opposed to the transfer chambers, the suction ports including at least part of a region in which the volume of each of the transfer chambers gradually increases, and the suction port of the first plate and the suction port of the second plate being formed at such positions as to be opposed to each other, discharge ports in the form of recesses are respectively formed in the face of the first plate and the face of the second plate, the faces being opposed to the transfer chambers, the discharge ports including at least part of a region in which the volume of each of the transfer chambers gradually decreases, and the discharge port of the first plate and the discharge port of the second plate being formed at such positions as to be opposed to each other, a discharge passage through which hydraulic fluid is discharged is connected to the discharge port of the first plate, and the discharge port of the second plate is connected to the discharge passage via the transfer chamber that has reached the discharge port of the second plate and the discharge port of the first plate, a first pressure gradually-changing groove and a second pressure gradually-changing groove are formed respectively in the first plate and the second plate so as to extend from the discharge ports toward the suction ports, the first and second pressure gradually-changing grooves being formed in a sealed region through which the transfer chamber that has reached end points of the suction ports passes before reaching start points of the discharge ports, the first and second pressure gradually-changing grooves gradually supplying the hydraulic fluid from the discharge ports to the transfer chamber that is passing through the sealed region, and the first pressure gradually-changing groove and the second pressure gradually-changing groove are formed such that a second flow passage area is larger than a first flow passage area, the first flow passage area being a flow passage area of the first pressure gradually-changing groove of the first plate, at a position at which the first pressure gradually-changing groove is communicated with the transfer chamber that is passing through the sealed region, and the second flow passage area being a flow passage area of the second pressure gradually-changing groove of the second plate, at a position at which the second pressure gradually-changing groove is communicated with the transfer chamber that is passing through the sealed region.

2. The oil pump according to claim 1, wherein the second flow passage area is made larger than the first flow passage area by setting the number of the second pressure gradually-changing grooves of the second plate larger than the number of the first pressure gradually-changing grooves of the first plate.

3. The oil pump according to claim 1, wherein a ratio of the second flow passage area to the first flow passage area is set such that a pressure of the hydraulic fluid flowing from the first pressure gradually-changing groove into the transfer chamber that is passing through the sealed region and a pressure of the hydraulic fluid flowing from the second pressure gradually-changing groove into the transfer chamber that is passing through the sealed region are equal to each other.

4. The oil pump according to claim 2, wherein a ratio of the second flow passage area to the first flow passage area is set such that a pressure of the hydraulic fluid flowing from the first pressure gradually-changing groove into the transfer chamber that is passing through the sealed region and a pressure of the hydraulic fluid flowing from the second pressure gradually-changing groove into the transfer chamber that is passing through the sealed region are equal to each other.

5. The oil pump according to claim 1, wherein the first flow passage area is a flow passage area of the first pressure gradually-changing groove of the first plate at a position at which the first pressure gradually-changing groove is initially communicated with the transfer chamber that is passing through the sealed region, and the second flow passage area is a flow passage area of the second pressure gradually-changing groove of the second plate at a position at which the second pressure gradually-changing groove is initially communicated with the transfer chamber that is passing through the sealed region.

* * * * *